US008474361B2

(12) United States Patent
Brittingham

(10) Patent No.: US 8,474,361 B2
(45) Date of Patent: Jul. 2, 2013

(54) PROCESS TO PRODUCE A SILENCER TUBE WITH MINIMAL WALL THICKNESS

(75) Inventor: Kevin Tyson Brittingham, Norcross, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 779 days.

(21) Appl. No.: 12/151,211

(22) Filed: May 5, 2008

(65) Prior Publication Data

US 2011/0056111 A1 Mar. 10, 2011

(51) Int. Cl.
*F41A 21/30* (2006.01)

(52) U.S. Cl.
USPC ..... 89/14.4; 89/14.7; 42/76.1

(58) Field of Classification Search
USPC ..... 42/76.1, 77; 89/14.4, 14.7; 181/223
See application file for complete search history.

(56) References Cited

U.S. PATENT DOCUMENTS 1,173,687 A * 2/1916 Thompson ..... 89/14.4
2,663,410 A * 12/1953 Kessler ..... 72/276
3,385,164 A 5/1968 Walther et al.
3,483,794 A * 12/1969 Packard ..... 89/14.2
3,667,570 A * 6/1972 WerBell, III ..... 181/223
4,974,489 A 12/1990 Fishbaugh
6,324,780 B1 * 12/2001 Behling ..... 42/78
6,575,074 B1 6/2003 Gaddini
6,810,615 B2 * 11/2004 Hermanson et al. ..... 42/76.1
6,931,776 B2 * 8/2005 Wagner et al. ..... 42/76.1
7,237,467 B1 7/2007 Melton
7,866,079 B2 * 1/2011 Keeney et al. ..... 42/76.1

* cited by examiner

*Primary Examiner* — Daniel J Troy

(74) *Attorney, Agent, or Firm* — Womble Carlyle Sandridge & Rice, LLP

(57) ABSTRACT

A method for reducing the weight of a silencer without compromising durability. By reducing the silencer housing wall thickness weight is removed from the silencer module. Areas on the housing where material is removed are primarily selected based on the internal pressure generated in a given chamber of the silencer. Further, removal of external material is selected based on the baffle arrangement. Individual chamber pressure is influenced by the muzzle pressure of the host firearm and the baffle style and baffle orientation within the silencer being used.

3 Claims, 2 Drawing Sheets

PROCESS TO PRODUCE A SILENCER TUBE WITH MINIMAL WALL THICKNESS

BACKGROUND OF THE INVENTION

1. Field of the Invention

This invention relates in general to firearms and in particular to an apparatus for suppressing the muzzle blast, attendant noise and visible signature of a discharging firearm.

2. Prior Art

Firearms silencers are well known in the prior art. The advantages of reducing the muzzle blast, noise and flash signature of a discharging firearm are well known. The invention being disclosed herein relates to the elimination of unnecessary weight from the silencer housing while not compromising the structural strength of the silencer as a whole.

Traditionally sound reduction, flash reduction and accuracy of the host firearm have been the only areas of significant focus for the majority of silencer manufactures. Overall weight has recently become an issue of significant concern due to military requirements. Methods for reducing the weight of the silencer without compromising its sound and flash reduction have not been heavily explored. Most attempts focus on methods which would reduce the silencers effectiveness. These methods simply shorten the silencer and remove critical components as a means to reduce weight.

A wide variety of techniques have been used to reduce the weight of a silencer. Material selection, reduced wall thickness of the tube and spacers, and the development of new baffles are just some of the areas where weight reduction is traditionally gained. Material selection and tube wall thickness are the areas of concern as it relates to the herein described invention.

Reduction of the tube wall thickness is, at a glance, an obvious way to reduce the weight of a silencer. Unfortunately nothing could be further from the truth. Reducing weight in the wrong areas will lead to premature failure of the silencer. Failure can include a rupture of the silencer tube thereby venting gasses to the periphery of the silencer rendering it infective. Fragment of the tube could be dislodged during the firing of the host firearm resulting in the injury of the shooter or bystanders. Collapse of the internal baffle structure resulting in the baffles occluding the bullet path preventing the user from utilizing the firearm as a weapon is also a possibility. All of the above happenings result in the silencer becoming useless and possibly a liability for the shooter.

It is the object of the invention herein described to provide a method of manufacturing a silencer tube which is lighter in weight as compared to a similar silencer model. The reduction of weight will be accomplished by removing unnecessary material from the tube wall. Material for the silencer tube is selected based on the use of the host firearm with which the completed silencer is to be used.

The location of material removed is selected based on the pressure present in the individual chambers immediately following the discharge of the host firearm. Chambers with a lower pressure will have the tube wall thickness reduced. Turning down the tubes external diameter and/or fluting are the two methods of material removal used on the preferred embodiment. Each individual chamber experiences a different pressure curve based on its proximity to the muzzle of the host firearm. Chambers located further away from the muzzle generally have lower chamber pressures. Models indicating individual chamber pressure may be generated in fluid dynamics software or in SolidWorks.

Material selection is another significant concern. The caliber and rate of fire of the host firearm will affect not only the tube wall thickness but also the material of said tube. 4140, 17-4 and 300 series stainless are popular materials for silencer tubes. High strength at high temperatures and availability are two reasons for the use of the above listed steels. Silencers which will be used on weapons capable of full auto fire will generate higher heat and expose the silencer to higher sustained chamber pressure as compared to long range precision weapons which will have a much lower rate of fire. Based on these criteria the areas and amount of material removed are decided.

Additional objects, advantages, and novel features of the invention will be set forth in part in the description as follows, and in part will become apparent to those skilled in the art upon examination of the following, or may be learned by practice of the invention.

3.Objects And Advantages

Accordingly several objects and advantages of the present invention are

1. To provide a method of manufacturing a silence tube with a diameter and profile optimized for weight reduction and strength.

2. To provide a method of manufacturing where the wall thickness of the silencer tube is selected based on the pressure present in the adjacent baffle chamber.

3. To provide various methods of tube wall thickness reduction based on the pressure present in each individual chamber.

Still further objects and advantages will become apparent from a consideration of the ensuing description and drawings.

SUMMARY

The present invention is a method of weight reduction for silencers. By removing material from the external tube the overall weight of the silencer is thereby reduced. Selecting the location for removal of material and the method of material removal is the primary focus of the herein described method of manufacture. Based on the muzzle pressure of the host firearm and the baffles used within the silencer tube, a number of chambers (the area between each baffle, firearm and end cap) is created. The chambers contain the gasses exiting the host firearm and serve as the area where the gases being redirected by the baffles are contained, and slowed. Each chamber experiences a relatively unique pressure curve based on its proximity to the muzzle of the host firearm. In general the further a given chamber is from the muzzle the lower that particular chamber's pressure is. The blast chamber or chamber immediately outside the muzzle of the firearm will experience the greatest pressures.

The caliber and method of operation of the host firearm is another area of significant interest. Weapons capable of high rates of fire up to and including fully automatic fire will in general require a tube wall thickness which will be greater as compared to that which is required by a manually loaded weapon. Firearms with a high rate of fire will generate heat and expose the silencer to a continuous barrage of high pressure. Wall thickness will also be affected by the material selected.

In a preferred embodiment, the silencer tube has a series of flutes about the periphery of the tube over the blast chamber. These flutes run a longitudinal path down the tube of at least 1". The second and third chambers of the silencer have progressively reduced dimensions. The outside diameter of the tube's wall thickness is reduced over each chamber. The second chamber has a thinner wall thickness as compared to the blast chamber and the third chamber has a thinner wall thickness as compared to the second chamber. This stepped down profile reduces the weight while providing optimal support for each chamber and the pressure experienced by that particular chamber. The combination of flutes and turning down the outside diameter of the tube reduced the weight of one preferred embodiment by 5 ounces.

In another preferred embodiment, the silencer features a series of flutes located about its periphery. The flutes are situated over the blast chamber. The second and each successive chamber all have the tubes outside diameter turned down to the same dimension. This design utilizes a blast chamber which goes over the barrel. Extra volume provided by the blast chamber reduces the pressures experienced by the second chamber and those following there after. The third chamber on this design may not be reduced further due to manufacturing concerns and weld ability of such a thin piece of material. This design provides 25% more internal volume as compared to the previous preferred embodiment. By reducing the tube profile and not leaving the tube the same external dimension for its entire length a weight savings of 8 oz is achieved.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
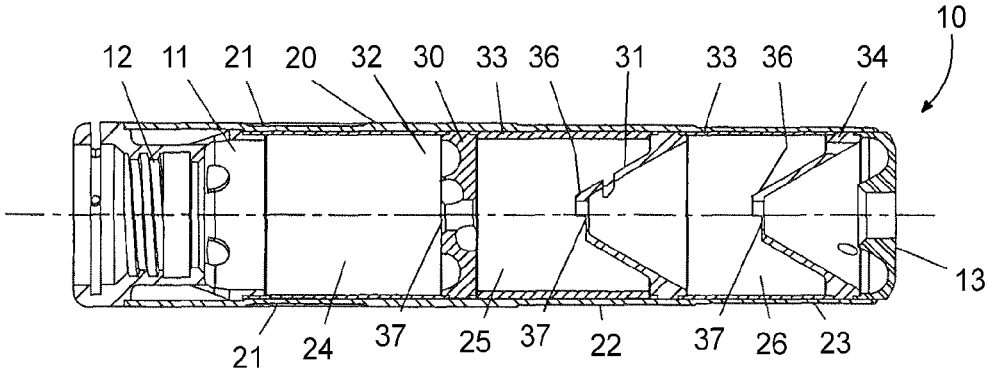
FIG. 1 shows a longitudinal section view of one preferred embodiment silencer taken substantially along line 1-1 of FIG. 4.
Figure 2:
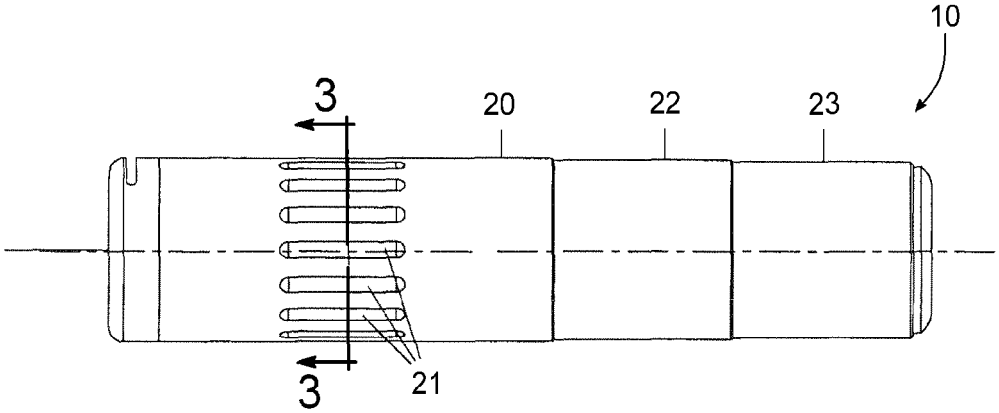
FIG. 2 shows an external plan view of the preferred embodiment silencer.
Figure 3:
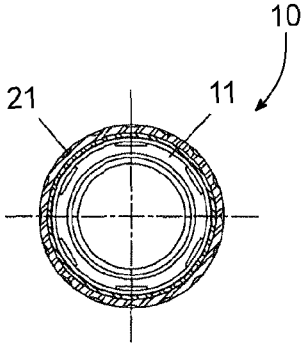
FIG. 3 shows a cross-sectional view of the preferred embodiment silencer taken substantially along line 3-3 of FIG. 2.
Figure 4:
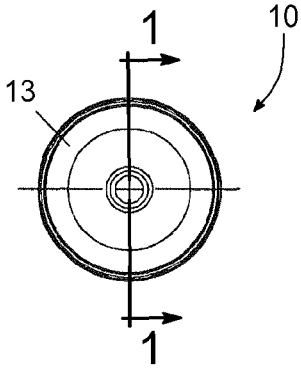
FIG. 4 shows a forward end view of the preferred embodiment silencer.
Figure 5:
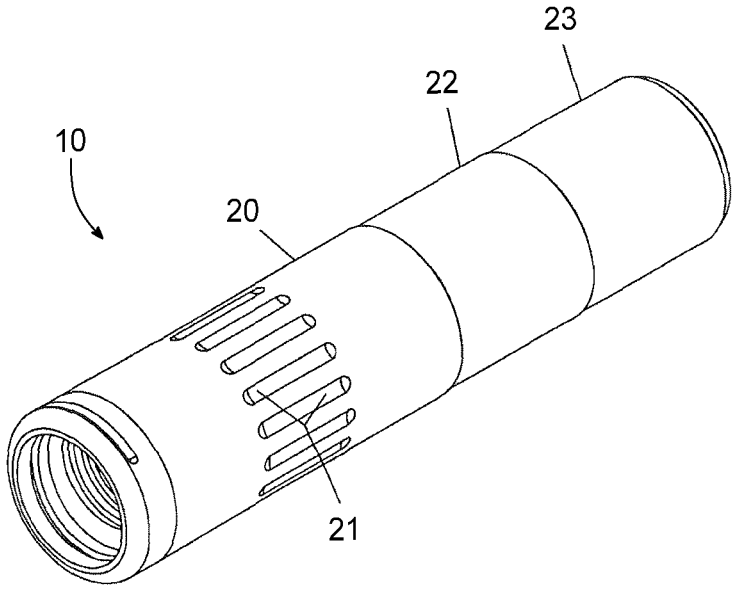
FIG. 5 shows an isometric view of one preferred embodiment silencer.

Turning now to the drawings in which like reference characters indicate corresponding elements throughout the several views, attention is directed to FIG. 1 which illustrates a preferred embodiment of the herein proposed invention a silencer 10 with a reduced wall thickness. The preferred embodiment silencer 10 with a reduced wall thickness is comprised of a mount 11 which serves as a means to secure the silencer 10 to the host firearm (not shown). The preferred embodiment mount 11 uses threads 12 to removably secure the silencer 10, and is located on the proximal end of the silencer assembly 10. The distal front end of the silencer 10 is a front end cap 13. A housing 20 is utilized to contain the silencer's 10 internal components. The internal volume of the silencer 10 is occupied by the combination of a blast baffle 30, a plurality of cone baffles 31, 34, blast baffle spacer 32 and support spacers 33. The area between the mount 11 and the blast baffle 30 is designated as the blast chamber 24. The areas between the blast baffle 30 and the cone baffle 31 and the second cone baffle 34 are referred to as the secondary 25 and final chambers 26 respectively. Externally the silencer housing 20 has a series of flutes 21 and a first reduction in wall thickness 22 between the blast baffle 30 and the first cone baffle 31. The second wall thickness reduction 23 is located between a cone baffle 31 and the second cone baffle 34. The front end cap 13 has a centrally located aperture 35 through which a bullet may pass.

Welds are used to secure the mount 11, blast baffle spacer 32, blast baffle 30, support spacers 33, cone baffle 31, second cone baffle 34, and front end cap 13, creating a sub assembly. The housing 20 is then slid over this sub assembly and welded to the mount 11 and front end cap 13. The baffles in one preferred embodiment are positioned so that the apex 36 of baffles 31 & 34 is facing the proximal end of the silencer 10 assembly. An initial spacer 32 separates and supports the mount 11 and the blast baffle 30. A spacer 33 is also used to separate and support the first cone baffle 31 from the second cone baffle 34. Finally the front end cap 13 is welded to the second cone baffle 34 to form a complete assembly. Even though welds are used to secure the preferred embodiment together it should be understood that this is not the exclusive way for assembly to occur. Threads for example could be used to assemble the herein described silencer 10 assembly.

As used herein, the word "front" or "forward" corresponds to the direction which a discharged projectile would pass through the silencer 10 or 14 (i.e., to the right as shown in FIGS. 1-2, 5 & 6); "rear" or "rearward" or "back" corresponds to the direction opposite the direction of a discharged projectile passing through one of the two shown embodiments of silencers (i.e., to the left as shown in FIGS. 1-2, 5 & 6); "longitudinal" means the direction along or parallel to the longitudinal axis a of silencer 10; and "transverse" means a direction perpendicular to the longitudinal direction.

In FIGS. 1-5, there are illustrated several views of a preferred embodiment silencer housing 20. The housing has a plurality of flutes 21 which are machined along a longitudinal path on the silencer housing 20. The housing 20 has three areas which have a different wall thickness. The housing 20 has two areas where the wall thickness is reduced as compared to the area of the housing 20 with the thickest wall. Areas near the middle and distal end of the housing 20 have a reduced external diameter as compared to the housing 20 closest to the proximal end of the housing 20. The first area of tube wall thickness reduction 22 and the secondary area of wall thickness reduction 23 are located roughly at the center and distal ends of the housing 20. The secondary area of wall thickness reduction 23 has a thinner wall profile as compared to the first area of wall thickness reduction 22.

Figure 6:
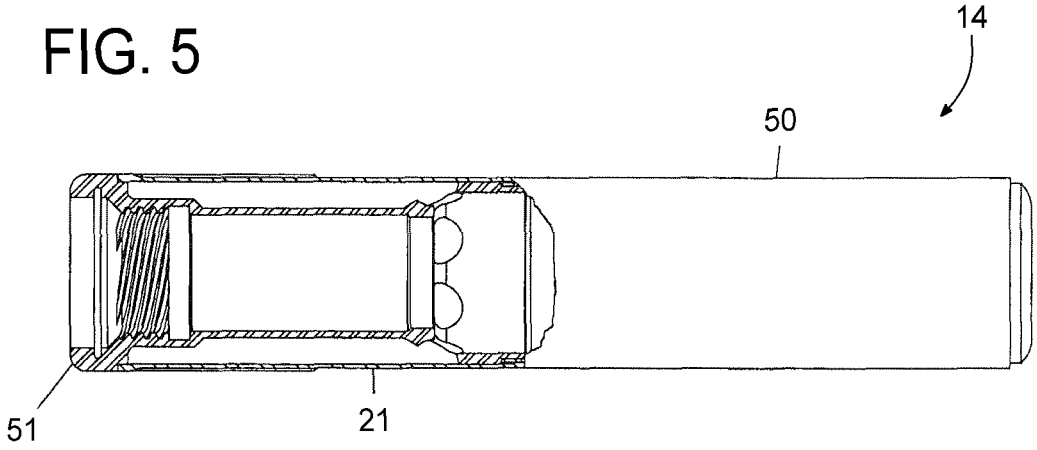
FIG. 6 shows a side view with a partial cut away revealing the mount of an alternate embodiment silencer.

In FIG. 6, there is illustrated a view of an alternate embodiment of a silencer 14 which is utilizing the process to produce a silencer tube with minimal wall thickness. This embodiment has only one area where the wall thickness is reduced as compared to the area with the highest wall thickness. This single reduction encompasses the majority of the silencer housing 50. This particular silencer 14 utilizes a mount 51 which is nearly three inches in length. The area around the mount incorporates a series of flutes 21. Firearms barrels and methods of attachment for silencers are well known in the prior art. This alternate embodiment silencer 14 is designed to mount over the exposed barrel of a firearm and covers approximately 3" of the barrel as measured from the crown.

Following the discharge of a firearm, expanding gases from the barrel pass through the mount 11 and into the blast chamber 24. The blast chamber 24 is formed between the mount 11 and the blast baffle 30. Gas passes through the aperture 37, provided on each of the baffles 30, 31 & 34, to fill each successive expansion chamber 25-26 where the baffles 30, 31 & 34, spacers 32-33, and housing 20 form the whole of the individual chambers. Expansion chamber 26 is sandwiched between a baffle 34 and the front end cap 13. This is the final chamber prior to the gasses passing into the atmosphere. As the gasses from the discharged firearm pass through the blast baffle 30 and the two cone baffles 31 & 34 into one of three expansion chambers 24-26 the baffles 31-32 & 34 increase turbulence by directing and forcing gasses out of line with the aperture 37 of each baffle. The conical shape of the baffles 32 & 34 forces the expanding gases away from the aperture 37 of the individual baffles and facilitate the gases' utilization of the entire volume of the initial expansion chamber 24 and each successive expansion chamber 25 & 26. By forcing the gasses to expand and delaying the exit of said gas through each expansion chamber reduces the sound and muzzle flash of the host firearm.

The tube of the preferred embodiment starts out with a wall thickness that is selected based on the caliber of the host firearm. Two areas of the tube are reduced in diameter effectively reducing the wall thickness of the tubing. Cylinders are the ideal shape for the containment of high pressure gases. The areas selected for weight reduction are based on the configuration of the internal baffle stack as shown in FIG. 1. The area immediately following the blast baffle 30 to the front of the first cone baffle 31 has the external wall reduced in thickness. The wall thickness is approximately thirty five percent less than the area of tubing located at the proximal end of the silencer housing 20. The area immediately following the first cone baffle 31 to the end of the housing 20 has a wall thickness which is reduced by approximately forty five percent as compared to the thickest area of the housing 20. The areas as described above are turned down to an approximately uniform diameter resulting in an approximate wall thickness as specified for each area.

The initial blast chamber 24 is the area of highest pressure and therefore needs the maximum housing 20 wall thickness if the preferred embodiment silencer 10 is to be durable and survive long strings of automatic rifle fire. The secondary 25 and final chamber 26 each respectively receive less pressure and heat prior to the expanding gases exiting the front end cap aperture 37. As each of the final two chambers receive less heat and pressure the external wall thickness of the housing 20 may be reduced thereby eliminating several ounces of weight from the silencer housing 20. Further weight is removed by machining flutes 21 or furrows into the housing 20 near the proximal end of the silencer 10. A plurality of flutes 21 machined in a longitudinal path along the silencer tube remove weight, provide a gripping surface with which to remove or install a silencer 10. The flutes 21 do not at there crest reduce the wall thickness of the housing 20 more than one-third of its overall wall thickness.

Based on the experience of the inventor the tube wall thickness may not be reduced to less than 0.030" due to concerns related to assembly. Threadedly assembling a durable silencer and/or welding a silencer housing which is thinner than 0.030 provide a myriad of problems which are out side the scope of this invention.

Accordingly the reader will see that, according to the invention, I have provided a method for reducing the weight of silencer housing. The area and method of weight removal ensure that that structural integrity of the silencer is not compromised. Further, the addition of multiple, longitudinal flutes around the proximal end of the silencer provide a gripping surface. The method as described above may be incorporated into virtually any silencer design. The area of wall thickness reduction and the placement of the flutes will not change.

While my above drawings and description contain many specificities, these should not be construed as limitations on the scope of the invention, but rather as an exemplification of one preferred embodiment thereof. For example, my design may be incorporated into other designs commonly referred to as over the barrel mounting system. Silencers which mount over the barrel provide a blast chamber which can be over two times as large as that found on muzzle mounted designs such as the mount present on the preferred embodiment. The addition of this extra blast chamber volume allows for a forty-five percent reduction of the tube wall thickness from the blast baffle to the end cap.

Accordingly, the scope of the invention should be determined not by the embodiments illustrated, but by the appended claims and their legal equivalents.

The invention claimed is:

1. A method of producing a firearm silencer with reduced weight without compromising durability thereof, comprising:

identifying at least one firearm criteria for a host firearm with which the silencer is to be used, including a caliber of the host firearm, method of operation of the host firearm, muzzle pressure, and/or a maximum expected temperature of the silencer;

selecting an initial tube wall thickness for forming a body of the silencer based on the at least one identified firearm criteria for a host firearm with which the silencer is to be used;

forming a tubular body of the silencer comprising a mount for attaching the silencer to a muzzle of the firearm, and at least a first portion defining a blast chamber adapted to be located adjacent the muzzle of the firearm, wherein the first portion comprises a wall thickness that is substantially equivalent to the selected initial wall thickness and which is substantially consistent along a length of the blast chamber;

selectively reducing the wall thickness of the tubular body at a location along the tubular body downstream from the first portion based upon a projected change in pressure of gases passing through the tubular body for forming at least a second portion of the tubular body, the second portion comprising an internal chamber separated from the blast chamber by a blast baffle, and having a substantially consistent wall thickness over its internal chamber that is of a reduced thickness from the initial wall thickness of the first portion;

wherein the tubular body is formed with a maximum wall thickness along the blast chamber where the pressure of gases entering the tubular body are highest, and has a reduced wall thickness downstream from the blast chamber where the pressure of the gases passing through the tubular body are reduced, enabling a reduction in weight of the silencer; and forming a third portion of the tubular body corresponding in position with a second expansion chamber positioned longitudinally distal to a an internal baffle between the second and third portions of the tubular body and further reducing a wall thickness in the third portion of the tubular body relative to the wall thickness of the second portion of the tubular body.

2. The method of claim 1, wherein the wall thickness of the third selected portion of the tubular body is reduced to approximately 45 percent less than the initial wall thickness of the first selected portion of the tubular body.

3. The method of claim 1 and further comprising positioning an internal baffle between the second and third portions of the tubular body.

* * * * *